United States Patent [19]

Leighton et al.

[11] Patent Number: 4,906,397

[45] Date of Patent: Mar. 6, 1990

[54] DETERGENT COMPOSITIONS UTILIZING DIVINYL ETHER POLYMERS AS BUILDERS AND NOVEL DIVINYL ETHER POLYMERS

[75] Inventors: John C. Leighton, Flanders; Carmine P. Iovine, Bridgewater, both of N.J.

[73] Assignee: National Starch and Chemical Corporation, Bridgewater, N.J.

[21] Appl. No.: 243,877

[22] Filed: Sep. 15, 1988

[51] Int. Cl.[4] ..... C11D 17/00

[52] U.S. Cl. ..... 252/174.24; 8/137; 252/174.14; 252/174.23; 252/180; 252/539; 252/54 D

[58] Field of Search ..... 252/174.23, 174.24; 8/137

[56] References Cited

U.S. PATENT DOCUMENTS

| | | | |
|---|---|---|---|
| Re. 26,407 | 6/1968 | Butler | 526/24 D |
| 2,640,039 | 5/1953 | Williams | 524/428 |
| 3,085,077 | 4/1963 | Floyd | 524/549 |
| 3,157,599 | 11/1964 | Gloor | 252/8.5 |
| 3,898,034 | 8/1975 | Szymanski et al. | 8/137 |
| 4,663,071 | 5/1987 | Bush et al. | 252/174.19 |
| 4,711,740 | 12/1987 | Carter et al. | 252/174.24 |

OTHER PUBLICATIONS

Morahan, Page S., et al., *Cancer Treat. Rep.*, 62(11) 1797–805 (1978).

Butler, G. B., *J. Macromol. Sci-Chem.*, A5(1), 219–227 (1971).

Butler, G., *J. Macromol. Sci. Chem.*, A6(8), 1533–68 (1972).

Stackman, Robert W., *J. Macromol. Sci. Chem.*, A5(1) 251–262 (1971).

*Primary Examiner*—A. Lionel Clingman

*Attorney, Agent, or Firm*—Mary E. Porter; Edwin M. Szala

[57] ABSTRACT

This invention provides detergent compositions utilizing divinyl ether/maleic anhydride polymers as detergent builders or co-builders. This invention also provides novel polymers of divinyl ether, maleic anhydride and at least one copolymerizable comonomer, selected from the group consisting of alkyl ethers, alkyl acrylates, carboxyalkyl ethers, vinyl esters of $C_1$ and $C_3$ or greater carboxylic acids, carboxylic acids, dicarboxylic acids and their esters, and olefins, and detergent compositions utilizing these novel polymer compositions as detergent builders.

8 Claims, No Drawings

DETERGENT COMPOSITIONS UTILIZING DIVINYL ETHER POLYMERS AS BUILDERS AND NOVEL DIVINYL ETHER POLYMERS

BACKGROUND OF THE INVENTION

This invention relates to detergent compositions utilizing a builder selected from the group comprising a copolymer of divinyl ether and maleic anhydride (DIVEMA), polymers of divinyl ether, maleic anhydride and vinyl acetate, and novel polymers of divinyl ether, maleic anhydride and at least one copolymerizable comonomer, selected from the group consisting of alkenyl alkyl ethers, alkyl acrylates, alkenyl carboxyalkyl ethers, vinyl esters of $C_1$ or $C_3$ or greater carboxylic acids, unsaturated carboxylic acids, unsaturated dicarboxylic acids and their esters, and olefins.

The DIVEMA copolymer is best known as an experimental antitumor and antiviral drug (Pyran). See Morahan, Page S., et al, *Cancer Treat. Rep.*, 62 (11) 1797–805 (1978). The preparation and the composition of the saturated linear DIVEMA copolymer were disclosed in U.S. Pat. No. Re. 26,407 to Butler, issued Jun. 11, 1968. Use of the DIVEMA copolymer, in a preferred molecular weight range from about 1,000 to about 10,000, as an aqueous dispersant for fine solids such as pigments, clay and organic polymers was disclosed in U.S. Pat. No. 3,085,077 to Floyd, issued Apr. 9, 1963. Its use as a water loss prevention agent in gas and oil well drilling fluids was disclosed in U.S. Pat. No. 3,157,599 to Gloor, issued Nov. 17, 1964.

The terpolymer of divinyl ether, maleic anhydride and vinyl acetate was disclosed in U.S. Pat. No. 2,640,039 to Williams, issued May 26, 1953. Additionally, this patent discloses the use of this terpolymer to thicken and size aqueous solutions, form gels or films, form protective colloids, disperse agents in aqueous solutions and replace gums.

The remaining class of polymers which are useful as builders in detergent compositions disclosed herein are novel polymers of divinyl ether, maleic anhydride and at least one selected copolymerizable comonomer.

Detergent compositions are generally a blend of a surfactant(s), builder(s) and, optionally, ion exchangers, fillers, alkalies, anticorrosion materials, antiredeposition materials, bleaches, enzymes, optical brighteners, fragrances and other components selected for particular applications.

Builders are used to improve the effectiveness of detergent compositions and thereby improve their whitening powers. Polyphosphate compounds, such as sodium tripolyphosphate, have long been in use as builders, particularly because of their relatively low cost and their utility in increasing the whitening powers of detergent compositions. It is theorized, however, that the presence of these polyphosphates tends to contribute to the growth of algae in lakes and rivers to a degree sufficient to cause eutrophication of these waters. For many years there has been legislative pressure to lower or discontinue their usage completely in detergent compositions to control phosphate pollution. Thus, detergent manufacturers continue to search for effective, nonphosphate detergent builders.

The manner in which detergent builders improve the cleaning powers of detergent compositions is related to a combination of such factors as emulsification of soil particles, solubilization of water insoluble materials, promoting soil suspension in the wash water so as to retard soil redeposition, sequestering of metallic ions, and the like.

Alternatives for sodium tripolyphosphate are widely used by detergent formulators. Many materials are or have been used as builders in detergent formulations. All have one or more drawbacks that offset their value in the formulations. Compositions and materials change frequently as formulators attempt to improve performance of cleaning while offering greater convenience in handling as well as keeping materials cost as low as possible.

Among the materials that have been suggested for use as detergent builders are the ether carboxylates disclosed in U.S. Pat. No. 4,663,071 to Bush, et al., issued May 5, 1987; the copolymers of maleic anhydride and sulfonated styrene or 2-acrylamido-2-methyl propane sulfonic acid disclosed in U.S. Pat. No. 4,711,740 to Carter, et al., issued Dec. 8, 1987; and the carboxylated bicyclic compounds and salts thereof disclosed in U.S. Pat. No. 3,898,034 to Szymanski, et al., issued Aug. 5, 1975.

Notwithstanding the existence of the foregoing types of detergent builders, there remains a continuing need to identify additional nonphosphorus sequestering agents, such as polymers prepared from divinyl ether and maleic anhydride, which can be prepared commercially and utilized as builders in commercial detergent compositions. Accordingly, it is an object of this invention to provide detergent compositions employing effective, non-phosphate builders as a replacement, in whole, or in part, for phosphate builders.

It is a further object of this invention to provide novel polymers of divinyl ether, maleic anhydride and at least one selected copolymerizable comonomer, which are useful as detergent builders.

SUMMARY OF THE INVENTION

This invention provides detergent compositions comprising from about 0.5% to 65% by weight of a surfactant and from about 1% to 80% by weight of a builder. The builder is selected from the group comprising a copolymer of divinyl ether and maleic anhydride (DIVEMA), polymers of divinyl ether, maleic anhydride and vinyl acetate, and novel polymers of divinyl ether, maleic anhydride and at least one copolymerizable comonomer which is selected from the group consisting of alkenyl alkyl ethers, alkyl acrylates, alkenyl carboxyalkyl ethers, vinyl esters of $C_1$ or $C_3$ or greater carboxylic acids, unsaturated carboxylic acids, unsaturated dicarboxylic acids and their esters, and olefins. At lower levels of usage in detergent compositions, these polymers may also be useful as anti-redeposition agents.

Polymers which are useful herein as detergent builders comprise from about 5 to 4,000 repeating units of the structure I (DIVEMA):

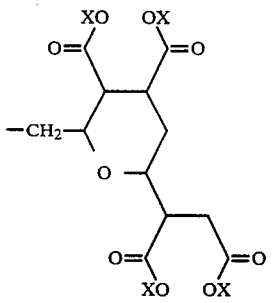

I

Structure I comprises one mole of divinyl ether and 2 moles of maleic anhydride. X is H, alkali metal ion, ammonium ion, hydroxyethylammonium ion or $C_1$–$C_{12}$ alkyl or cycloalkyl.

The builder polymers optionally further comprise at least one copolymerizable comonomer selected from the group consisting of alkenyl alkyl ethers, alkyl acrylates, alkenyl carboxyalkyl ethers, vinyl esters of carboxylic acids, unsaturated carboxylic acids, unsaturated dicarboxylic acids and their esters, and olefins. these comonomers are selected so as to maintain the saturated, substantially linear polymer structure which is obtained by cyclocopolymerization. The optional comonomer(s) may be present in any proportion provided that the polymer contains structure I and function as an effective detergent builder. This invention also provides novel polymers, of divinyl ether, maleic anhydride and at least one copolymerizable comonomer, selected from the group consisting of alkenyl alkyl ethers, alkyl acrylates, alkenyl carboxyalkyl ethers, vinyl esters of $C_1$ or $C_3$ or greater carboxylic acids, unsaturated carboxylic acids, unsaturated dicarboxylic acids and their esters, and olefins which are useful as detergent builders. Such polymers are exemplified by compositions wherein the comonomer is isobutyl vinyl ether, methyl acrylate, methyl vinyloxyacetate, acrylic acid, itaconic acid, or styrene.

These polymers may be utilized in the salt (e.g., sodium, potassium, ammonium, monoethanolamine or triethanolamine) or in the alkyl or cycloalkylester form (structure I), or in the anhydride form (structure II). The number average molecular weight of these polymers in the anhydride form is between 1,300 and 1,100,000.

Detergent compositions of this invention comprise any of the compositions which are used for cleaning purposes, wherein the builder is selected from the builders disclosed herein. Thus, the compositions include liquid and dry blends useful for household laundry detergents, automatic dishwashing machine detergents, hard surface cleaners, and industrial and specialty cleaning products.

DESCRIPTION OF THE PREFERRED EMBODIMENTS

DIVINYL ETHER POLYMERS

The DIVEMA copolymer useful as a detergent builder herein is a saturated, substantially linear polymer of the type described in Butler, G. B., *J. Macromol. Sci.-Chem.*, A5(1), 219–227 (1971). The copolymer may be prepared by the method disclosed in U.S. Pat. No. Re. 26,407 to Butler, issued Jun. 11, 1968, which is hereby incorporated by reference. Alternatively, it may be prepared by any method known in the art for cyclocopolymerization of dienes and alkenes to yield a saturated, substantially linear copolymer. In preparing the copolymer, the divinyl ether and maleic anhydride monomers are quantitatively converted to the DIVEMA copolymer in a molar ratio of 1:2.

In the anhydride form, the DIVEMA copolymer comprises from about 5 to 4,000 repeating units of structure II:

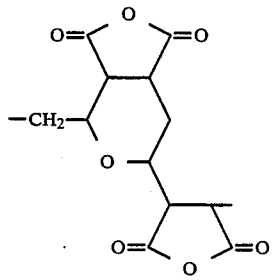

II

The anhydride structure II and the salt structure I are shown as the six-member ring DIVEMA isomer. A five-member ring DIVEMA isomer has also been identified. For the purposes of this invention, either or both DIVEMA isomers may be employed. Additionally, either the salt or the ester or the anhydride form may be employed.

The molecular weight corresponding to 5 to 4,000 repeating units of II ranges from about 1,300 to 1,100,000. The ranges of the molecular weight of the copolymer are limited only by the method of preparation, and effectiveness of the polymer as a builder. The corresponding number average molecular weight of the fully neutralized sodium salt of the copolymer ranges from about 2,000 to 1,600,000. In a preferred embodiment the sodium carboxylate salt of the polymer is prepared by dissolving the anhydride in water and neutralizing it with sodium hydroxide in the manner disclosed in Example XVII of U.S. Pat. No. Re. 26,407. The practitioner will recognize that if the anhydride form of the polymer is incorporated into a detergent formulation, hydrolysis to the carboxylic acid form will occur under typical washing or cleaning conditions. The sodium, potassium, ammonium, monoethanolamine or triethanolamine carboxylate salt of the polymer are also preferred. However, with the exception of the polyvalent cations responsible for water hardness, any organic or inorganic base may be utilized in preparing the salt of the polymer.

In a second preferred embodiment, a $C_1$-$C_{12}$ alkyl or cycloalkyl ester of the polymer is formed by reacting the anhydride with an excess of $C_1$-$C_{12}$ alcohol. This reaction may be conducted in an aprotic solvent (e.g., toluene). Suitable alkyl esters may be prepared with any alkyl alcohol (e.g., lauryl alcohol); and suitable cycloalkyl esters may be prepared with any cycloalkyl alcohol (e.g., cyclohexanol).

The remaining divinyl ether/maleic anhydride polymers are also prepared by the method disclosed in U.S. Pat. No. Re. 26,407, except that at least one copolymerizable comonomer, selected from the group consisting of alkenyl alkyl ethers, alkyl acrylates, alkenyl carboxyalkyl ethers, vinyl esters of carboxylic acids, unsaturated carboxylic acids, unsaturated dicarboxylic acids and their esters, and olefins, is added to the reaction medium. Like the DIVEMA copolymer, the remaining divinyl ether/maleic anhydride polymers are saturated, substantially linear polymers whose sodium salts have number average molecular weights in the range between 2,000 and 1,600,000.

The salts and esters of the divinyl ether/maleic anhydride polymers comprise repeat units of the structure III:

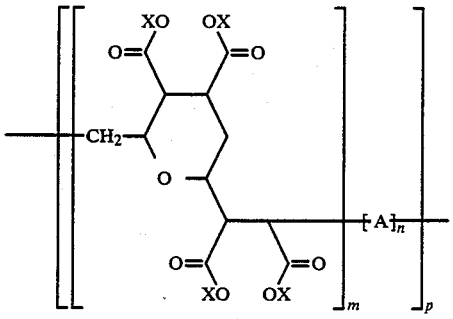

III

Structure I represents the DIVEMA copolymer and is an essential component of the builders and the novel polymers claimed herein.

Structure A represents at least one copolymerizable comonomer, selected from the group consisting of alkenyl alkyl ethers, alkyl acrylates, alkenyl carboxyalkyl ethers, vinyl esters of carboxylic acids, unsaturated carboxylic acids, unsaturated dicarboxylic acids and their esters, and olefins. Structure A may consist of one or more of the selected comonomer(s). Certain of these comonomers (e.g., acrylic acid and maleic acid) are known to form homopolymers and copolymers which have commercial utility as detergent builders (e.g., acrylic acid/maleic acid copolymer and polyacrylic acid).

Structure A is an optional component of the builders, but an essential component of the novel polymers of this invention. Thus, in the novel polymers of this invention, both m and n must be greater than zero and p may range from about 5 to 4,000.

For detergent builder purposes, m must be greater than zero, n may be zero or greater, and p may range from 5 to about 4,000. The practitioner will recognize that as the ratio of n to m increases, the preferred selection of comonomer(s) will shift toward those comonomers with known effectiveness as calcium or magnesium sequestrants or as detergent builders. Likewise, as the ratio of m to n increases, the builder effectiveness of the comonomer(s) becomes less critical and other factors, such as cost and detergent formulation compatibility will guide comonomer(s) selection.

In a preferred embodiment, a novel terpolymer is prepared containing a molar ratio of 1:3:1 of divinyl ether, maleic anhydride and isobutyl vinyl ether, exemplifying the class of alkenyl ether monomers. In a second preferred embodiment, a novel terpolymer is prepared containing a molar ratio of 1:3:1 of divinyl ether, maleic anhydride and methyl acrylate, exemplifying the class of alkyl acrylate monomers. In a third preferred embodiment, a novel terpolymer is prepared containing a molar ratio of 1:3:1 of divinyl ether, maleic anhydride and acrylic acid, exemplifying the class of unsaturated carboxylic acids. In a fourth preferred embodiment, a novel terpolymer is prepared containing a molar ratio of 1:3:1 of divinyl ether, maleic anhydride and methyl vinyloxyacetate, exemplifying the class of alkenyl carboxyalkyl ethers. (The methyl vinyloxyacetate may be hydrolyzed after polymerization to yield pendant carboxylic acid groups.) In a fifth preferred embodiment, a novel terpolymer is prepared containing a molar ratio of 1:3:1 of divinyl ether, maleic anhydride and itaconic acid, exemplifying the class of unsaturated dicarboxylic acids. In a sixth preferred embodiment, a novel terpolymer is prepared containing a molar ratio of 1:3:1 of divinyl ether, maleic anhydride and styrene, exemplifying the class of olefins.

In a seventh preferred embodiment, a known terpolymer is prepared containing a molar ratio of 1:3:1 of divinyl ether, maleic anhydride and vinyl acetate, exemplifying the class of vinyl esters of carboxylic acids. The novel compounds herein are limited to polymers which do not contain vinyl acetate, and therefore, the copolymerizable comonomers are limited to vinyl esters of $C_1$ or $C_3$ or greater carboxylic acids.

It will be recognized by the practitioner that although cyclocopolymerized saturated linear copolymers of divinyl ether, and maleic anhydride will not vary from the 1:2 molar ratio, the other divinyl ether/maleic anhydride polymers of this invention are not so limited. Thus, although both divinyl ether and maleic anhydride must be present to form the other cyclocopolymerized polymers, the molar ratio of divinyl ether, maleic anhydride and the comonomer(s) may vary.

Similarly, the practitioner will recognize that although certain comonomers are selected for the preferred embodiments disclosed herein, any monomers within the selected class may be utilized. Furthermore, small quantities of polyfunctional comonomers which are not within the selected classes may be utilized, provided the resulting polymers retain their effectiveness as detergent builders. Examples of such polyfunctional comonomers are acrylates and methacrylates of polyols, allyl and vinyl esters of polycarboxylic acids, divinyl benzene, and the like.

The alkenyl alkyl ether monomers useful herein include vinyl methyl ether, vinyl ethyl ether, vinyl n-propyl ether, vinyl i-propyl ether, vinyl n-butyl ether, vinyl sec-butyl ether, vinyl t-butyl ether, vinyl pentyl ether, higher vinyl alkyl ethers, and the like.

The alkyl acrylate monomers useful herein include methyl acrylate, ethyl acrylate, propyl acrylate, butyl acrylate, pentyl acrylate, and higher acrylates and corresponding 2-substituted acrylates where the 2-substitution is $C_1$–$C_6$ alkyl and cycloalkyl, and the like.

The alkenyl carboxyalkyl ethers useful herein include methyl vinyloxyacetate, methyl vinyloxypropionate, methyl vinylbutanoate, methyl vinyloxypentanoate, vinyl 3,3-dicarboxymethylpropyl ether, vinyl 3,3,3-tricarboxymethylpropyl ether, and the like.

The polymerizable unsaturated carboxylic and dicarboxylic acid monomers useful herein include acrylic acid, methacrylic acid, maleic acid, itaconic acid, crotonic acid, and the like.

The olefins useful herein include ethylene, propylene, 1-butene, 1-pentene, higher olefins, and substituted olefins such as styrene and the like.

The vinyl esters useful herein include vinyl formate, vinyl acetate, vinyl propionate, vinyl butanoate, vinyl pentanoate, vinyl neodecanoate, and the like.

Other saturated, substantially linear polymers, containing one, two or more comonomer(s) in addition to the divinyl ether and maleic anhydride comonomers, are intended to fall within the scope of this invention, provided that they do not render the polymer ineffective as a detergent builder.

Additionally, although only one method of preparation of these polymers was employed in the preferred embodiments disclosed herein, it is intended that the polymers of this invention may be prepared by any method known in the art. The only limitations are that the polymer be prepared as a saturated, substantially linear cyclocopolymerized product containing the divinyl ether monomer, which upon hydrolysis of the anhydride rings of the polymer, forms dicarboxylic acid groups that are available for chelating metallic ions. Acceptable methods of preparation are known in the art and include Butler, G., *J. Macromol. Sci., Chem*, A5(1) 219–227 (1971); Butler, G., *J. Macromol., Sci., Chem.*, A6(8) 1533–68 (1972); and Stackman, Robert W., *J. Macromol., Sci., Chem.*, A5(1) 251–262 (1971).

DETERGENT COMPOSITIONS

The detergent formulations comprise from about 0.5 to 65% by weight of a surfactant, or a blend of surfactants, and 1to 80% by weight of a divinyl ether/maleic anhydride polymer builder, or a blend of builders containing at least one divinyl ether/maleic anhydride polymer. In a preferred embodiment, from about 0.5 to 30% by weight of a surfactant, or a blend of surfactants, and from about 2 to 65% by weight of a divinyl ether/-maleic anhydride polymer builder, or a blend of builders containing at least one divinyl ether/maleic anhydride polymer, are employed.

Optional components of the detergent formulations include, but are not limited to, ion exchangers, alkalies, anticorrosion materials, anti-redeposition materials, optical brighteners, fragrances, dyes, fillers, chelating agents, enzymes, fabric whiteners and brighteners, sudsing control agents, solvents, hydrotropes, bleaching agents, bleach precursors, buffering agents, soil removal agents, soil release agents, fabric softening agent and opacifiers.

These optional components may comprise up to about 90% of the detergent formulation. Examples of these optional components, commonly used surfactants and various builders are set forth in detail in U.S. Pat. No. 4,663,071 to Bush, issued May 5, 1987 which is hereby incorporated by reference.

In a preferred embodiment, a divinyl ether/maleic anhydride polymer builder is incorporated into a powdered household laundry detergent formulation, comprising 10–25% surfactant(s), 2–63% builder(s), and 12–88% optional components, such as buffers, enzymes, softeners, antistatic agents, bleaches, optical brightners, perfumes, and fillers.

In a second preferred embodiment, a divinyl ether/-maleic anhydride polymer builder is incorporated into a liquid household laundry detergent formulation, comprising 5–50% surfactant(s), 2–55% builder(s), and 15–95% of a combination of optional ingredients, such as buffers, enzymes, softeners, antistatic agents, fluorescers, perfumes, water and fillers. Also useful herein are any detergent formulations, used commercially or experimentally, which employ a phosphate co-builder or phosphate-replacer builder or co-builder, or any builder which functions chiefly to sequester calcium, magnesium and other polyvalent cations present in hard water. Formulations employing mixtures of builders, including phosphate-containing mixtures, are also useful.

In a third preferred embodiment, a divinyl ether/-maleic anhydride polymer builder is incorporated into a detergent formulation for use in automatic dishwashing machines, comprising from about 2–6% relatively low sudsing nonionic surfactant(s) (e.g., alkoxylation products of compounds containing at least one reactive hydrogen, such as BASF-Wyandotte Corporation's Pluronic®, Tetronic® and Pluradot®), 2–65% builder(s), and 29–96% optional components, such as suds control agents (e.g., mono-and distearyl acid phosphates), fragrances, and fillers.

The detergent compositions of this invention may take any of the physical forms associated with detergent compositions, such as powders, granules, cakes and liquids. They may also be produced by any of the techniques commonly employed in the manufacture of detergent compositions, including slurry-making and spray-drying processes for the manufacture of detergent powders. The builder may be incorporated in the slurry or blended with spray-dried base powder. The practitioner will recognize which formulations are best suited to the physical form selected for a particular detergent composition and adjust the formulation accordingly. For example, terpolymers containing hydrophobic monomers such as methyl acrylate or isobutyl vinyl ether, are preferred in liquid formulations because their hydrophobicity tends to stabilize the detergent and prevent phase separation of the surfactant and the builder.

This invention is illustrated by the following examples.

EXAMPLE 1

This example illustrates the preparation of the DIVEMA copolymer.

A. Preparation of Divinyl Ether Monomer

Divinyl ether was prepared by the dehydrohalogenation of beta-chloroethyl ether with sodium in 2-ethylhexanol. The 2-ethylhexanol (650 ml) was charged to a four-neck 2 liter flask equipped with a coil condensor cooled with ice water, a heating mantle, a thermometer and a glass stirrer, and heated to 100° C. While purging with nitrogen, sodium metal (48.3 g; 2.10 mol) was added at a sufficiently slow rate to maintain the temperature below 130° C. After the sodium had dissolved, the beta-chloroethyl ether (143.0 g; 1.00 mol) was added over one hour at 90° C. The temperature was raised to 170° C. and a crude reaction product (b.p. 29°–90° C.) was recovered by distillation. The product was redistilled twice (b.p. 28°–30° C.) and 19.0 g divinyl ether (27.1% yield) was obtained.

B. Preparation of DIVEMA Copolymer

Copolymerization of the divinyl ether with maleic anhydride was by the method disclosed in Butler, G. B., *J. Macromol. Sci.-Chem.*, A5(1) 219–227 (1971), at page 222–23. The crude product contained 0.64% residual maleic anhydride.

The molecular weight of the copolymer in anhydride form was measured by gel permeation chromatograph in DMSO against dextran standards. The weight average molecular weight of the anhydride form of the DIVEMA copolymer was 54,700. The number average molecular weight was determined to be 3,570. The intrinsic viscosity was 0.853 in dimethylformamide.

A sodium carboxylate copolymer was obtained upon dissolution of the anhydride copolymer in water, followed by neutralization with sodium hydroxide.

EXAMPLE 2

This example illustrates the preparation of the remaining class of divinyl ether/maleic anhydride polymers.

The polymers were prepared by the same method as the copolymer in Example 1, except that a third comonomer was added to the reaction vessel.

The following mole ratio terpolymers were prepared:

A. 1:3:1 divinyl ether/maleic anhydride/isobutyl vinyl ether;

B. 1:3:1 divinyl ether/maleic anydride/methyl acrylate;

C. 1:3:1 divinyl ether/maleic anhydride/vinyl acetate;

D. 1:3:1 divinyl ether/maleic anhydride/acrylic acid;

E. 1:3:1 divinyl ether/maleic anhydride/methyl vinyl oxyacetate; and

F. 1:3:1 divinyl ether/maleic anhydride/itaconic acid.

G. 1:3:1 divinyl ether/maleic anhydride/styrene.

Sodium carboxylate salts of these polymers were obtained upon dissolution of the anhydride polymer in water and neutralization with sodium hydroxide.

EXAMPLE 3

This example illustrates the effectiveness of these polymers in calcium sequestration.

Four solutions of calcium chloride in water, containing, respectively, 60, 120, 180 and 240 ppm $Ca^{++}$ ion, were each treated with 0.1, 0.2, 0.3 and 0.4 g/l of the experimental and control builders. A calcium ion selective electrode (Corning Radiometer F2110 Calcium Selective Electrode) was used to measure the free $Ca^{++}$ ion concentration of the treated solutions.

The detergent builders tested for calcium ion sequestration included the DIVEMA copolymer of Example 1, terpolymers A-G of Example 2 and two detergent builders which are commercially used. The commercial builders were Sokalan ® CP-7 (a trademark registered to BASF Corporation and used in connection with a 2:1 copolymer of acrylic acid and maleic acid) and AlN (a polyacrylic acid) sold by Rohm & Haas.

Results expressed as p ($Ca^{++}$) are set forth in Table I. All treatments resulted in higher p ($Ca^{++}$) (indicating lower concentration of free $Ca^{++}$ ion remained in solution following treatment) as the treatment level was increased. Overall, the DIVEMA copolymer and terpolymers A-G sequestered calcium ions as effectively as the commercially used detergent builders. The Sokalan CP-7 builder was slightly more effective at lower calcium ion concentration levels. Terpolymers C and D (vinyl acetate and acrylic acid) were slightly more effective than Sokalan CP-7 at higher calcium concentration levels.

Thus the polymers of this invention effectively sequester calcium ions in solution.

TABLE I

Calcium Sequestration at 60 ppm, 120 ppm, 180 ppm and 240 ppm $Ca^{++}$

| Builder | ppm $Ca^{++}$ | Treatment Level (g/l)** 0.1 | 0.2 | 0.3 | 0.4 |
|---|---|---|---|---|---|
| Sokalan ® CP7 | 60 ppm | 3.81 | 4.91 | 5.99 | 6.41 |
| | 120 ppm | 3.20 | 3.44 | 4.31 | 4.99 |
| | 180 ppm | 2.94 | 3.08 | 3.48 | 3.88 |
| | 240 ppm | 2.77 | 2.88 | 3.12 | 3.32 |
| Rohm & Haas AlN | 60 ppm | 3.50 | 3.96 | 4.38 | 4.63 |
| | 120 ppm | 3.06 | 3.25 | 3.51 | 3.77 |
| | 180 ppm | 2.83 | 2.95 | 3.11 | 3.25 |
| | 240 ppm | 2.69 | 2.77 | 2.88 | 2.97 |
| DIVEMA Copolymer | 60 ppm | 3.82 | 4.73 | 5.23 | 5.70 |
| | 120 ppm | 3.20 | 3.61 | 4.07 | 4.80 |
| | 180 ppm | 2.91 | 3.11 | 3.45 | 4.01 |
| | 240 ppm | 2.73 | 2.86 | 3.09 | 3.50 |
| Terpolymer A (Isobutyl vinyl ether) | 60 ppm | 3.78 | 4.78 | 5.37 | 5.67 |
| | 120 ppm | 3.13 | 3.58 | 4.21 | 4.75 |
| | 180 ppm | 2.86 | 3.11 | 3.47 | 3.93 |
| | 240 ppm | 2.70 | 2.86 | 3.08 | 3.39 |
| Terpolymer B (Methyl Acrylate) | 60 ppm | 3.68 | 4.37 | 4.98 | 5.55 |
| | 120 ppm | 3.12 | 3.44 | 3.85 | 4.48 |
| | 180 ppm | 2.86 | 3.05 | 3.29 | 3.70 |
| | 240 ppm | 2.70 | 2.83 | 2.99 | 3.25 |
| Terpolymer C (Vinyl Acetate) | 60 ppm | 3.88 | 4.66 | 5.27 | 5.62 |
| | 120 ppm | 3.28 | 3.62 | 4.11 | 4.60 |
| | 180 ppm | 3.04 | 3.19 | 3.47 | 3.84 |
| | 240 ppm | 2.80 | 2.96 | 3.14 | 3.40 |
| Terpolymer D (Acrylic Acid) | 60 ppm | 4.03 | 5.27 | 5.41 | 5.82 |
| | 120 ppm | 3.34 | 4.11 | 4.21 | 4.85 |
| | 180 ppm | 3.06 | 3.45 | 3.53 | 4.06 |
| | 240 ppm | 2.89 | 3.13 | 3.17 | 3.53 |
| Terpolymer E (methyl vinyl oxyacetate)* | 60 ppm | 3.92 | 4.62 | 5.34 | 6.08 |
| | 120 ppm | 3.38 | 3.65 | 3.88 | 4.44 |
| | 180 ppm | 3.12 | 3.29 | 3.40 | 3.77 |
| | 240 ppm | 2.95 | 3.07 | 3.14 | 3.37 |
| Terpolymer F (Itaconic Acid) | 60 ppm | 3.64 | 4.28 | 4.94 | 5.41 |
| | 120 ppm | 3.13 | 3.40 | 3.71 | 4.13 |
| | 180 ppm | 2.89 | 3.07 | 3.24 | 3.45 |
| | 240 ppm | 2.73 | 2.87 | 2.99 | 3.14 |
| Terpolymer G (Styrene) | 60 ppm | 3.72 | 4.57 | 4.77 | 5.43 |
| | 120 ppm | 3.16 | 3.54 | 3.81 | 4.65 |
| | 180 ppm | 2.90 | 3.13 | 3.29 | 3.84 |
| | 240 ppm | 2.74 | 2.89 | 3.01 | 3.34 |

*Methyl ester of the vinyl oxyacetate was not hydrolyzed during preparation of the sodium salt.

**Terpolymer G was in the anhydride form. All other terpolymers were in sodium salt form.

EXAMPLE 4

This example illustrates the preparation and detergency of household laundry detergent compositions employing the builders disclosed herein.

Detergent composition suitable for use as powdered household laundry detergent were prepared according to the following single active anionic formulations:

Anionic Surfactant Formulations

| Component | % by Weight in Formulation 1 | 2 | 3 | 4 | 5 |
|---|---|---|---|---|---|
| Formula No: | | | | | |
| Sodium Alkylbenzene Sulfonate (C13) | 15 | 15 | 15 | 15 | 15 |
| Sodium Carbonate | 18 | 18 | 18 | 18 | 18 |
| Sodium Silicate | 20 | 20 | 20 | 20 | 20 |
| Sodium Sulfate | 47 | 17 | 27 | 27 | 27 |
| Sodium Tripoly phosphate | | 30 | | | |
| Sokalan CP-7 | | | 20 | | |
| [a]DIVEMA Copolymer | | | | 20 | |
| [a]Terpolymer D (Acrylic Acid) | | | | | 20 |

[a]Weight percentage of sodium salt of polymer.

Detergency evaluations were conducted in a Terg-o-tometer (U.S. Testing Company) employing detergency monitor cloths which are similar to the widely used detergency monitor cloths sold by Test Fabrics Company. Clay/Particulate type; Fatty/Particulate type;

(Vacuum Cleaner Dust); and Fatty/Oily type cloths were used. Water hardness was adjusted to 60, 120 or 180 ppm polyvalent cations (calculated as calcium carbonate; 2:1 ratio of Ca++: Mg++). Water at the appropriate hardness was first added to the Terg-o-tometer beaker. The appropriate amounts of the detergent formulations were then added to make one liter of detergent solution having a total concentration of 1.5 gm/liter. Divinyl ether/maleic anhydride polymers were preneutralized with NaOH. After the test solution reached the desired wash temperature (40° C.), the detergency monitor cloths were introduced (4-8 cloths per beaker) and the wash cycle begun (100 rpm). After washing 10 minutes, the cloths were rinsed for 1 minute, dried and their reflectances were recorded using a Gardener reflectometer (Model Colorgard System 05). Using the reflectances of the clean, soiled and washed cloths, the % detergency was calculated according to the following relationship:

$$\% \text{ Detergency} = \frac{R_{washed} - R_{soiled}}{R_{clean} - R_{soiled}} \times 100$$

As the effectiveness of the detergent formulation improves, the percentage detergency increases.

The detergency results are given in Table II for clay soil cloths at three water hardnesses. It is clear from these results that DIVEMA copolymer and terpolymer provide substantial detergency building across all water hardnesses. They are similar in effectiveness to sodium tripolyphosphate (STP) as well as Sokalan CP-7.

Additionally, the results set forth in Table II demonstrate that the polymers of the present invention are effective when used in formulations containing calcium sensitive anionic surfactants.

TABLE II

| Formula No. | Percentage Detergency 60 ppm[a] | 120 ppm[a] | 180 ppm[a] |
|---|---|---|---|
| 1 | 43.6 | 41.1 | 34.5 |

TABLE II-continued

| Formula No. | Percentage Detergency 60 ppm[a] | 120 ppm[a] | 180 ppm[a] |
|---|---|---|---|
| Control (0%) | | | |
| 2 | 74.0 | 73.7 | 61.0 |
| Sodium Tripolyphosphate (30%) | | | |
| 3 | 67.7 | 64.7 | 53.7 |
| Sokolan CP-7 (20%) | | | |
| 4 | 64.3 | 59.4 | 49.7 |
| DIVEMA Copolymer (20%) | | | |
| 5 | 63.6 | 59.6 | 49.3 |
| Terpolymer D (Acrylic Acid) (20%) | | | |

[a]Polyvalent cations.

EXAMPLE 5

This example illustrates the preparation and detergency of household laundry detergent compositions employing the builders of this invention in the following mixed surfactant formulations:

| Mixed Surfactant Formulations-3 | | | | | | | |
|---|---|---|---|---|---|---|---|
| Component | % by Weight in Formulation | | | | | | |
| Formula No: | 3-1 | 3-2 | 3-3 | 3-4 | 3-5 | 3-6 | 3-7 |
| Na $C_{11}$–$C_{15}$ Alkylbenzene Sulfonate | 10 | 10 | | 10 | 11.5 | 10 | 10 |
| Alcohol Ethoxylate[b] | 5 | 5 | 10 | | | | |
| Na Alcohol Ethoxy (7E0) Sulfate[c] | | | | 5 | | 5 | 5 |
| Na Tallow Alcohol Sulfate | | | | | 11 | | |
| Sodium Carbonate | 18 | 18 | 30 | 18 | 18 | 18 | 18 |
| Sodium Silicate | 20 | 20 | 8 | 20 | 8 | 20 | 10 |
| Sodium Sulfate | 27 | 27 | 32 | 27 | 31.5 | 37 | 37 |
| [a]DIVEMA Copolymer | 20 | | 20 | 20 | 20 | 10 | 20 |
| [a]Terpolymer D (Acrylic Acid) | | 20 | | | | | |

| Mixed Surfactant Formulations-4 | | | | | | |
|---|---|---|---|---|---|---|
| Component | % by weight in Formulation | | | | | |
| Formula No.: | 4-1 | 4-2 | 4-3 | 4-4 | 4-5 | 4-6 |
| Na $C_{11}$–$C_{15}$ Alkylbenzene Sulfonate | 10 | 10 | 10 | 10 | 10 | |
| Neodol 25-9 | 5 | 5 | 5 | 5 | 5 | |
| Alfonic ® 1412-70 | | | | | | 5 |
| Na $C_{13}$–$C_{15}$ Alkylbenzene Sulfonate | | | | | | 10 |
| Sodium Carbonate | 18 | 18 | 18 | 18 | 18 | 18 |
| Sodium Silicate | 5 | 5 | 5 | 5 | 20 | 20 |
| Sodium Sulfate | 62 | 32 | 47 | 32 | 47 | 47 |
| [a]DIVEMA Copolymer | | | 15 | 30 | | |
| Sodium Tripoly Phosphate | | 30 | | | | |

[a]Weight percentage of sodium salt of polymer.
[b]Alfonic ® 1412-70 (12–14C alcohol ethoxylate containing 70% ethylene oxide by weight).
[c]Sulfated Alfonic ® 1412-70.

Detergency evaluations were by the method set forth in Example 4, except that only 120 ppm water hardness was used for all samples and Fatty/Particulate and Fatty/Oily type cloths were used for Mixed Surfactant Formulations-4 testing.

Results are shown in Table III. The divinyl ether builders improve detergency of mixed surfactant formulations for household laundry use over a range of laundry soil types.

TABLE III

| Formula No. | Percentage Detergency Clay/Particulate Soil[a] | Fatty/Particulate Soil[a] | Fatty/Oily Soil[a] |
|---|---|---|---|
| 3–1[b] | 62.1 | — | — |
| 3–2[b] | 58.7 | — | — |
| 3–3[b] | 51.5 | — | — |
| 3–4[b] | 60.0 | — | — |
| 3–5[b] | 61.0 | — | — |
| 3–6[b] | 57.4 | — | — |
| 3–7[b] | 57.8 | — | — |
| 4–1 | | 33.6 | 42.4 |
| (Control) | | 43.9 | 53.0 |

TABLE III-continued

| Formula No. | Percentage Detergency Clay/Particulate Soil[a] | Fatty/Particulate Soil[a] | Fatty/Oily Soil[a] |
|---|---|---|---|
| 4-2 (Sodium Tripoly phosphate) | | | |
| 4-3[b] | | 39.7 | 50.0 |
| 4-4[b] | | 42.3 | 50.4 |
| 4-5 (Control) | | 38.1 | 44.3 |
| 4-6 (Control) | | 37.1 | 45.9 |

[a]Cloths washed in 120 ppm water hardness.
[b]Divinyl ether polymer builder.

EXAMPLE 6

This example illustrates the preparation and detergency of household laundry detergent formulations employing divinyl ether/maleic anhydride polymers as co-builders and sodium citrate or zeolites as the primary builder.

Detergent compositions were prepared according to the following formulations:

| Component | Co-Builder Formulations % by Weight in Formulation | | | | | |
|---|---|---|---|---|---|---|
| Formula No: | 5-1 | 5-2 | 5-3 | 5-4 | 5-5 | 5-6 |
| Na Alkylbenzene Sulfonate (C13) | 10 | 10 | 10 | 10 | 10 | 10 |
| Na Alcohol Ethoxy (7EO) Sulfate | 5 | 5 | 5 | 5 | 5 | 5 |
| Sodium Carbonate | 18 | 18 | 18 | 18 | 18 | 18 |
| Sodium Silicate | 3 | 3 | 3 | 3 | 3 | 3 |
| Sodium Sulfate | 54 | 49 | 45 | 44 | 39 | 39 |
| Sodium Citrate | 10 | 10 | 10 | | | |
| 4A Zeolite | | | | 20 | 20 | 20 |
| [a]DIVEMA Copolymer | | 5 | | | 5 | |
| [a]Terpolymer-D (Acrylic Acid) | | | 5 | | | 5 |

[a]Weight percentage of sodium salt of polymer.

Detergency evaluations were conducted as in Example 4, except that Fatty/Particulate and Clay/Particulate cloths were employed in 120 ppm water hardness testing. Results are shown in Table IV.

Low levels of divinyl ether/maleic anhydride polymers produce improvements in detergency when employed as co-builders in detergent formulations containing sodium citrate or zeolite builder. Thus, they are useful as co-builders.

TABLE IV

| Formula No. | Percentage Detergency Clay/Particulate Soil[a] | Fatty/Particulate Soil[a] |
|---|---|---|
| 5-1 (Sodium Citrate Control) | 52.6 | 37.5 |
| 5-2[b] | 60.0 | 40.4 |
| 5-3[b] | 55.3 | 39.1 |
| 5-4 (Zeolite Control) | 54.6 | 42.0 |
| 5-5[b] | 55.0 | 44.8 |
| 5-6[b] | 55.3 | 44.7 |

[a]Cloths washed in 120 ppm water hardness
[b]Divinyl ether polymer builder.

EXAMPLE 7

This example illustrates the preparation and detergency of household laundry detergent compositions employing the anhydride form of divinyl ether/maleic anhydride polymers as builders.

Detergent compositions were prepared according to the following formulations:

| Component | Anhydride and Sodium Salt Formulations % by Weight in Formulation | | | | | |
|---|---|---|---|---|---|---|
| Formula No: | 6-1 | 6-2 | 6-3 | 6-4 | 6-5 | 6-6 |
| Na Alkyl Benzene Sulfonate (C13) | 10 | 10 | 10 | 10 | 10 | 10 |
| Sodium Carbonate | 30 | 30 | 30 | 30 | 30 | 30 |
| Sodium Silicate | 20 | 20 | 20 | 20 | 20 | 20 |
| Sodium Sulfate | 35 | 30 | 9.8 | 9.3 | 14.5 | 14.1 |
| Sodium Tripolyphosphate | | 30 | | | | |
| DIVEMA Copolymer | | | | | 36.5 | |
| (as Na Salt) | | | | | | |
| (as Anhydride) | | | 25.2 | | | |
| Terpolymer D (Acrylic Acid) | | | | | | |
| (as Na Salt) | | | | | | 36.9 |
| (as Anhydride) | | | | 25.7 | | |

Detergency evaluations were conducted by the method of Example 4, except that:

(1) In formulations 6-3 and 6-4 the builder was used as a solid anhydride added directly to the wash water;

(2) All washes were 14 minutes at 40° C. 100 rpm and at a 2:1 ratio of $Ca^{++}$: $Mg^{++}$ water hardness;

(3) Fatty/Particulate and Clay/Particulate cloths were tested; and (4) The pH of the wash water was measured after 2 and 7 minutes. Results are shown in Table V.

TABLE V

| Formula No. | Percentage Detergency pH 2 min. | pH 7 min. | Clay/Particulate Soil[a] | Fatty/Particulate Soil[a] |
|---|---|---|---|---|
| 6-1 | 10.1 | 10.1 | 42.8 | 41.0 |
| Control | 10.1 | 10.2 | 71.8 | 51.0 |
| 6-2 Sodium Tripoly Phosphate | | | | |
| 6-3[b,c] | 9.1 | 9.1 | 66.2 | 47.4 |
| 6-4[b,c] | 9.0 | 9.1 | 64.2 | 45.9 |
| 6-5[b] | 10.2 | 10.2 | 66.5 | 49.3 |
| 6-6[b] | 10.1 | 10.2 | 66.4 | 49.4 |

[a]Cloths washed in 120 ppm water hardners.
[b]Divinyl ether polymer builder.
[c]Anhydride form.

The results show that the anhydride form did not perform as well as the salt on Fatty/Particulate Soil cloth. However, this cloth is particularly sensitive to wash pH. The anhydride form lowers the pH of the wash as shown by pH data in Table V. It is expected that an increase in the alkali content of the detergent formulation would raise wash pH and improve anhydride detergency results on Fatty/Particulate Soil Cloth.

On Clay/Particulate Soil cloth, which is less sensitive to pH, the anhydride form performed as well as the salt. Thus, the divinyl ether/maleic anhydride polymers may be employed as a builder in powdered detergents in the salt or anhydride form.

EXAMPLE 8

This example illustrates the preparation and detergency of household laundry detergent compositions employing various divinyl ether/maleic anhydride terpolymers as builders. Additionally, this example illustrates the use of monoethanolamine, a common organic alkalinity control agent useful in the formulation of liquid detergents.

Detergent compositions were prepared according to the following formulations:

| Formulations Containing Divinyl Ether/Maleic Anhydride Terpolymers | | | | | |
|---|---|---|---|---|---|
| Component | % by Weight in Formulation | | | | |
| Formula No: | 7-1 | 7-2 | 7-3 | 7-4 | 7-5 |
| Na Alkylbenzene Sulfonate (C11) | 17 | 17 | 17 | 17 | 17 |
| Neodol ® 25-9 | 7 | 7 | 7 | 7 | 7 |
| Monoethanolamine | 2 | 2 | 2 | 2 | 2 |
| Sodium Sulfate | 49 | 49 | 49 | 49 | 74 |
| Sodium Citrate | 25 | | | | |
| [a]Terpolymer A (Isobutyl Vinyl Ether) | | 25 | | | |
| [a]Terpolymer B (Methyl Acrylate) | | | 25 | | |
| [a]Terpolymer C (Vinyl Acetate) | | | | 25 | |

[a]Weight percentage of sodium salt of polymer

Detergency evaluations were conducted as in Example 4, except that Clay/Particulate and Fatty/Particulate Soil cloths were washed at 120 ppm water hardness. Results are shown in Table VI.

TABLE VI

| Formula No. | Percentage Detergency: Clay/Particulate Soil[a] | Percentage Detergency: Fatty/Particulate Soil[a] |
|---|---|---|
| 7-1 | 43.0 | 36.0 |
| Sodium Citrate | | |
| 7-2[b] | 58.0 | 42.1 |
| 7-3[b] | 53.0 | 40.1 |
| 7-4[b] | 52.8 | 39.5 |
| 7-5 | 37.2 | 33.5 |
| Sodium Sulfate | | |

[a]Cloths washed in 120 ppm water hardness.
[b]Divinyl ether/maleic anhydride terpolymer builder.

The results show that divinyl ether/maleic anhydride terpolymers are effective detergent builders in detergent formulations. Furthermore, these builders are significantly more effective than sodium citrate which is a commonly used non-phosphate detergent builders.

EXAMPLE 9

This example illustrates the preparation of liquid household laundry detergent compositions employing the builders disclosed herein.

Liquid detergent compositions for household laundry use are prepared according to the following formulations:

| Liquid Laundry Detergents | | | | | | |
|---|---|---|---|---|---|---|
| Component | % by Weight in Formulation | | | | | |
| Formula No: | 8-1 | 8-2 | 8-3 | 8-4 | 8-5 | 8-6 |
| Actives | | | | | | |
| Sodium $C_{11}$-$C_{15}$ Alkylbenzene Sulfonate | 8 | 17 | 10 | | | 7 |
| Alcohol Ethoxy Sulfate[a] | 12 | | 6 | | | 1 |
| Alcohol Ethoxylate[b] | 8 | 7 | 8 | 16 | 8 | 4 |
| Alkylpolycoside[c] | | | | | 16 | 15 |
| Builders | | | | | | |
| Trisodium Citrate | 0-15 | 0-15 | 0-10 | 0-20 | 10 | 10 |
| Soap | 0-10 | 0-15 | | | 5 | 4 |
| Carboxymethyloxysuccinate, trisodium | | | | | 10 | 0-20 |
| Oxydisuccinate, tetrasodium | | | | | | 6 |
| Divinyl Ether Polymers | 5-15 | 2-20 | 2-15 | 1-10 | 5 | 2-15 |
| Buffers | | | | | | |
| Monoethanolamine | 1 | 2 | 2 | 0-4 | | 2 |
| Triethanolamine | | | 2 | | 4 | 4 |
| Sodium Carbonate | | | | | | 1 |
| Enzymes | | | | | | |
| Protease (Savinase, Alcalase, etc.) | 1 | — | 1 | 0.5 | 1 | 0.75 |
| Amylase (Termamyl) | 0.5 | — | — | 0.5 | 1 | 0.5 |
| Lipase (Lipolase) | 1 | — | — | 0.5 | 1 | 1 |
| Enzyme Stabilizers | | | | | | |
| Borax Pentahydrate | | | 3.5 | | 4 | 4 |
| Glycerol | | | 4 | | 6 | 5 |
| Propylene Glycol | 10 | | | 10 | 2 | 5 |
| Formic Acid | 1 | | | 1 | | 1 |
| Calcium Chloride | 1 | | 1 | 1 | 1 | 1 |
| Softeners & Antistats | | | | | | |
| Quaternary Amines (Arquad 2HT) | | | | 2 | | |
| Ethoxylated Amine[d] | 1 | | | 2 | 1 | |
| Alkyldimethyl Amine Oxide[e] | | | | 1.5 | | |
| Compatibilizing Agents | | | | | | |
| Na Xylene Sulfonates | 3 | 6 | 3 | 2 | | 3 |
| Ethanol | 10 | | 2 | 8 | 3 | 3 |
| Fluorescers | | | | | | |
| Tinopal UNPA | 0.25 | 0.2 | 0.25 | 0.25 | 0.2 | 0.15 |
| Perfume | 0.2 | 0.15 | 0.1-0.3 | 0.2 | 0.25 | 0.1-0.25 |
| Water | To Balance | | | | | |

[a]Sulfated Alfonic ® 1412-60 (12-14 C alcohol ethoxylate, containing 60% ethylene oxide by weight, sodium salt.)
[b]Alfonic ® 1412-70 (12-14 C alcohol) ethoxylate.
[c]APG 300 (obtained from Horizon Chemical).
[d]Varonic ® U202 (obtained from Sherex Corporation).
[e]Ammonyx MO (obtained from Stepan Chemical).

EXAMPLE 10

This example illustrates the preparation of representative, powdered detergent compositions for general cleaning which employ the builders disclosed herein.

Household detergent compositions for general cleaning use are prepared according to the following formulations:

| Component | % by Weight in Formulation | | | | | |
|---|---|---|---|---|---|---|
| Formula No: | 9-1 | 9-2 | 9-3 | 9-4 | 9-5 | 9-6 |
| Actives | | | | | | |
| Sodium $C_{11}$-$C_{13}$ Alkylbenzene Sulfonate | 11 | 11.5 | 17 | 11 | 15 | |
| Alcohol Ethoxy Sulfate[a] | | 5.5 | | | | |
| Primary Alcohol Sulfate | 10 | | | 9 | 5 | |
| Alcohol Ethoxylate[b] | | 3 | | 2 | 3 | 10 |
| Soap | 1 | | | | 1 | |
| Builders | | | | | | |
| Sodium Tripolyphosphate | | | | | 25 | |
| Aluminosilicates, e.g., Zeolite 4A | 10-35 | 0-15 | 5-20 | 0-12 | | |
| Polycarboxylate, e.g., CP-5 | 0-3 | | | | | |
| Divinyl Ether Polymers | 2-25 | 2-25 | 2-25 | 2-25 | 5 | 2-20 |
| Buffers | | | | | | |
| Alkaline Silicate | 2-5 | 20 | 5 | 3-20 | 15 | 15 |
| Sodium Carbonate | 18 | 18 | 15 | 30 | 20 | 40 |
| Enzymes | | | | | | |
| Protease (Savinase, Alcalase, etc.) | 0.5 | 0-1 | 0.5 | 0.5 | 1 | 1 |
| Amylase (Termamyl) | 0.4 | | | 0.5 | 0.5 | |
| Lipase (Lipolase) | 1.0 | 0-1 | | 0.5 | 1 | 1 |
| Softeners & Antistats | | | | | | |
| Quaternary Amines (Aquad 2HT) | | | 2.4 | | | |
| Ethoxylated Amine[c] | | | 2 | | | |
| Swelling Clay | | | 10 | | | |
| Fluorescers | | | | | | |
| Tinopal AMS | 0.15 | 0.2 | 0.25 | 0.15 | 1.5 | 1.5 |
| Perfume | 0.1 | 0.2 | 0.1 | 0.1 | 0.1 | 0.1 |
| Fillers | | | | | | |
| Na Sulfate | To Balance | | | | | |

[a]Sulfated Alfonic ® 1412-70 (b, Example 5).
[b]Neodol ® 25-9 (12-15C alcohol, 9 mole ethylene oxide condensate).
[c]Varonic ® U202 (obtained from Sherox Corporation).

Although emphasis has been placed on laundry detergent compositions in these examples, detergent compositions for all cleaning purposes are included within the scope of this invention. Various modifications and improvements on the compositions herein will become readily apparent to those skilled in the art. Accordingly, the scope and spirit of the invention are to be limited only by the claims and not by the foregoing specification.

We claim:

1. A detergent composition, comprising from about 0.5 to 65% by weight of a surfactant and from about 1 to 80% by weight of a builder, wherein the builder is a polymer comprising a repeating unit of the structure:

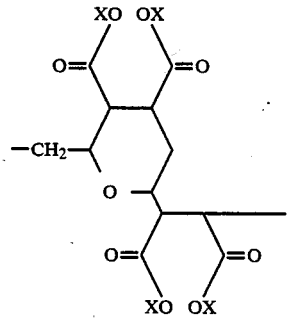

wherein X is H, or an alkali metal ion, ammonium ion, or hydroxyethylammonium ion, or a $C_1$-$C_{12}$ alkyl substituent, or a $C_5$-$C_{12}$ cycloalkyl substituent having at least one five- or six-membered ring, or a combination thereof.

2. The detergent composition of claim 1, wherein the builder is a polymer further comprising a repeating unit of the structure:

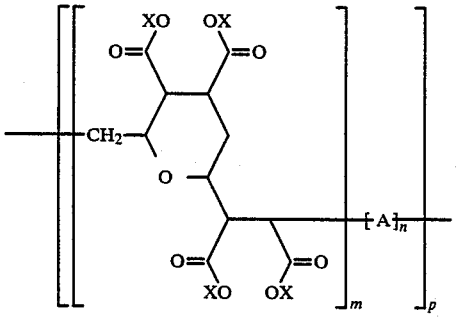

wherein A is a repeating unit derived from at least one copolymerized comonomer selected from the group consisting of alkenyl alkyl ethers, alkyl acrylates, alkenyl carboxyalkyl ethers, vinyl esters of carboxylic acids, unsaturated carboxylic acids, unsaturated dicarboxylic acids and their esters, and olefins; X is H, or an alkali metal ion, ammonium ion, or hydroxyethylammonium ion, or a $C_1$-$C_{12}$ alkyl substituent, or a $C_5$-$C_{12}$ cycloalkyl substituent having at least one five- or six membered ring, or a combination thereof; m and n are greater than 1; and p is from 5 to 4,000.

3. A detergent composition, comprising from about 0.5 to 65% by weight of a surfactant and from about 1 to 80% by weight of a builder, wherein the builder is a polymer, comprising a repeating unit of the structure:

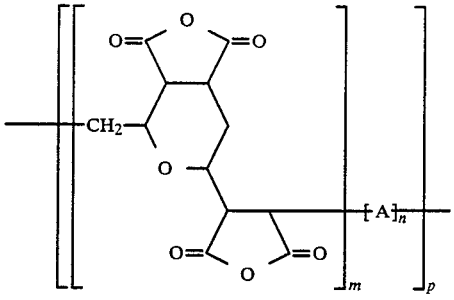

wherein A is a repeating unit derived from at least one copolymerized comonomer selected from the group consisting of alkenyl alkyl ethers, alkenyl alkyl acrylates, alkenyl carboxyalkyl ethers, vinyl esters of carboxylic acids, unsaturated carboxylic acids, unsaturated dicarboxylic acids and their esters, and olefins; m is greater than 1; n is zero or greater; and p is from 5 to 4,000.

4. The detergent composition of claim 1, wherein the composition further comprises more than one surfactant.

5. The detergent composition of claim 1, wherein the composition further comprises more than one builder.

6. The detergent composition of claim 1, wherein the builder is a sodium, potassium, ammonium, monoethanolamine or triethanolamine salt of the polymer.

7. The detergent composition of claim 1, comprising from about 0.5 to 30% by weight of a surfactant and from about 1 to 65% by weight of the builder.

8. A method for washing fabric, comprising agitating the fabric in the presence of water and a detergent composition, comprising from about 0.5 to 65% by weight of a surfactant and from about 1 to 80% by weight of a builder, wherein the builder is a polymer comprising a repeating unit of the structure:

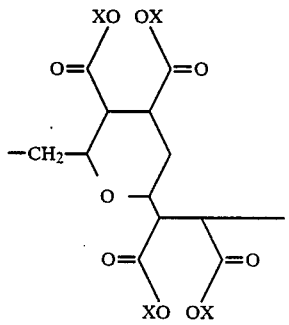

wherein X is H, or an alkali metal ion, ammonium ion, or hydroxyethylammonium ion, or a $C_1$–$C_{12}$ alkyl substituent or a $C_5$–$C_{12}$ cycloalkyl substituent having at least one five-or six-membered ring, or a combination thereof.

* * * * *